US005618207A

United States Patent [19]

Maejima

[11] Patent Number: 5,618,207

[45] Date of Patent: Apr. 8, 1997

[54] RETAINING METHOD AND DOUBLE-RETAINING CONNECTOR THEREFOR

[75] Inventor: Toshiro Maejima, Shizuoka, Japan

[73] Assignee: Yazaki Corporation, Tokyo, Japan

[21] Appl. No.: 374,874

[22] Filed: Jan. 19, 1995

[30] Foreign Application Priority Data

Jan. 19, 1994 [JP] Japan ..... 6-017754

[51] Int. Cl.[6] ..... H01R 13/40

[52] U.S. Cl. ..... 439/595; 439/752

[58] Field of Search ..... 439/595, 752, 439/733

[56] References Cited

U.S. PATENT DOCUMENTS

| | | | |
|---|---|---|---|
| 5,061,210 | 10/1991 | Jinno | 439/595 |
| 5,071,369 | 12/1991 | Denlinger et al. | 439/595 |
| 5,183,418 | 2/1993 | Yamanashi et al. | 439/595 |

FOREIGN PATENT DOCUMENTS

| | | | |
|---|---|---|---|
| 0356222 | 2/1990 | European Pat. Off. | 439/595 |

*Primary Examiner*—Neil Abrams

*Assistant Examiner*—Eugene Byrd

*Attorney, Agent, or Firm*—Sughrue, Mion, Zinn, Macpeak & Seas

[57] ABSTRACT

A double-retaining connector in which a double-retaining operation can be effected easily and positively and a retaining portion will not be inadvertently influenced by an external force. A spacer 2 is inserted into terminal receiving chambers 4 from a rear end of a housing 1, and each spacer piece 16 at a front end of the spacer 2 moves past a retaining projection 5*a* of a retaining lance 5, and is held in a provisionally-retained position forwardly of the retaining lance 5. Then, a connection terminal 3 is inserted into the terminal receiving chamber 4 from the rear end of the housing 1, and moves past a retaining protuberance 6 to be retained against rearward withdrawal. At the same time, the retaining projection 5*a* of the retaining lance 5 fits in a retaining hole in an electrical contact portion of the connection terminal 3, thereby achieving a double retaining of the connection terminal. Finally, the spacer 2 is partially pulled out in a direction opposite to the direction of insertion of the connection terminal, so that the spacer piece 16 sits in a flexing space beneath the retaining lance 5, thereby completely retaining the spacer. As a result, the flexing of the retaining lance 5 is prevented, and the connection terminal 3 is positively and doubly retained within the terminal receiving chamber 4.

6 Claims, 7 Drawing Sheets

RETAINING METHOD AND DOUBLE-RETAINING CONNECTOR THEREFOR

BACKGROUND OF THE INVENTION

1. Field of the Invention

This invention relates to a retaining construction for retaining connection terminals, used for electrically connecting a wire harness in an automobile or the like, within a connector housing, and more particularly to a double-retaining connector in which the connection terminals are retained in a double manner by a preset-type terminal retainer which is inserted into the connector housing before the connection terminals are inserted respectively into terminal receiving chambers.

2. Related Art

Conventional double-retaining connectors for preventing connection terminals that are inserted into a connector housing from being withdrawn are disclosed in Japanese Patent Examined Publication No. 5-4789 and Japanese Patent Unexamined Publication No. 2-158067. These are commonly known as front spacer types. In these conventional housings, a terminal retainer is inserted into a connector housing from a front end thereof. A rear holder type is disclosed in Japanese Patent Unexamined Publication No. 4-366571, for example.

A conventional front spacer type is shown in FIG. 7. A male connector housing A made of a rigid synthetic resin is fitted on a mating female connector housing (not shown), and has a locking arm 21 and a waterproof hood 22 provided on an outer peripheral portion thereof.

A spacer B serving as a terminal retainer is first partially inserted into the male connector housing A from a front end thereof, and is provisionally held. At this time, lock pawls 26*a*, formed on a provisional lock plate 26 having a top plate 28 for closing upper sides of terminal receiving chambers 23, are received in a gap V between side walls 24 of the terminal receiving chambers 23. A stopper 29*a*, formed on a central portion of a lower surface of a horizontal base plate portion 29, fits in a notched portion 25.

Thereafter, a connection terminal 36 is inserted into the terminal receiving chamber 23 from a rear end of the connector housing A. The connection terminal includes an electrical contact portion 38, a wire connection portion 39 having a wire W clamped thereto, and a waterproof plug 37 fitted on a rear end portion thereof. At this time, the connection terminal 36 is primarily retained by an elastic arm (not shown) provided within the terminal receiving chamber 23.

Finally, the spacer B is further inserted so as to be completely retained. Each retaining projection 27*a*, formed on an elastic terminal retaining plate 27 at the front end of the horizontal base plate portion 29, engages a retaining hole 38*a* in the corresponding connection terminal 36. The connection terminal 36 is thereby doubly retained within the terminal receiving chamber 23.

A rear holder type is shown in FIG. 8. A rear holder D serving as a terminal retainer is first partially inserted into a retainer mounting chamber 45 provided at a rear end of a female connector housing C made of a synthetic resin, and is provisionally held. More specifically, the rear holder D enters the retainer mounting chamber 45 in such a manner that retaining grooves 49 in the rear holder D are guided respectively by retaining protuberances 58 formed respectively on inner surfaces of side walls 43 of the connector housing C. At this time, a recessed portion 53 in a lower surface of the rear holder D is supported by a guide tongue 64. Two retaining levers 51 enter retaining chambers 59, respectively, and retaining projections 48*c* of lock arms 48 are slidably engaged respectively by tapering surfaces 57*a* of retaining portions 57, and are flexed inwardly. Then, the retaining projections 48*c* slide past the tapering surfaces 57*a*, respectively, and positioning projections 63 are engaged with the front surface of the rear holder D, thereby provisionally retaining the rear holder.

Then, a male connection terminal E, connected to one end of a wire W, is inserted through an opening 47 into a terminal receiving chamber 41 in a housing body $A_1$ having at its upper surface a lock chamber 42 for receiving a lock arm of a mating connector housing (not shown). At this time, a retaining lance (not shown), providing within the terminal receiving chamber 41, is engaged in a retaining hole 68 in the connection terminal E, thereby retaining this terminal primarily.

Finally, the rear holder D is urged upwardly from the lower side, so that retaining pawls 51*a* of the retaining levers 51 move into respective retaining holes 60 past respective provisionally-retaining projections 61 in the respective retaining chambers 59. Retaining projections 50 are respectively supported by the retaining projections 58, and rear holder D is thus fully retained. A wire clamping portion 67 of the connection terminal E is retained by the rear holder D, so that the connection terminal E is doubly retained.

In the front spacer type shown in FIG. 7, in the provisionally-retained condition, part of the spacer B is projected from the front end face of the connector housing A. A problem develops in that before the connection terminals 36 are inserted, the spacer B is urged into the completely-retained condition by an external force developing due to a packing arrangement or when handling the connector. Therefore, in order to insert the connection terminals 36, it is necessary to withdraw the spacer B held in the completely-retained condition, and the efficiency of mounting of the connection terminals 36 is greatly lowered.

In the rear holder type shown in FIG. 8, since the double retaining is effected utilizing the wire clamping portion 67 formed at the rear end of the connection terminal E, the front end of the rear holder D and the rear end of the wire clamping portion 67 always need to be abutted against each other. Therefore, in view of the length of the connection terminal E, it is necessary to form the abutting portion thereof into a slanting configuration, and the configuration becomes complicated. This results in a problem that the costs of the design and manufacture are increased.

With the above problems in view, it is an object of this invention to provide a double-retaining connector in which a double-retaining operation can be effected easily and positively, and a retaining portion will not be influenced by an external force and so on.

SUMMARY OF THE INVENTION

The above and other objects of the present invention have been achieved by a retaining method for doubly retaining connection terminals in a double-retaining connector, comprising the steps of: inserting a terminal retainer, for retaining connection terminals within terminal receiving chambers of a connector housing, from a rear end of said connector housing, said terminal retainer being inserted in a first direction; holding said terminal retainer in a provisionally-retained position; inserting said connection terminals into corresponding terminal receiving chambers so that said connection terminals are respectively retained by a retaining protuberance provided on respective first sides of said terminal receiving chambers and elastic retaining lances provided on respective second sides of said terminal receiving chambers opposite said first sides, said connection terminals each being connected to one end of a wire; and after said connection terminal insertion step, moving said terminal retainer in a second direction opposite said first direction, thereby locking said retaining lance.

The above and other objects of the present invention have been achieved by providing a double-retaining connector for retaining connection terminals, comprising: a connector housing; terminal receiving chambers, for receiving the connection terminals, provided in said connector housing; retaining protuberances, respectively provided in said terminal receiving chambers on respective first sides of said terminal receiving chambers, for retaining the connection terminals; elastic retaining lances, respectively provided in said terminal receiving chambers on respective second sides of said terminal receiving chambers opposite said first sides, for retaining the connection terminals; and a terminal retainer, insertable into a rear end of said connector housing in an inserting direction, for retaining the connection terminals in said terminal receiving chambers, wherein said terminal retainer is selectively fixable in said connector housing in a first fully inserted provisional position in which said elastic retaining lances are not locked and a second partially inserted final position in which said elastic retaining lances are locked by said terminal retainer, said terminal retainer being moved from said first position to said second position in a direction opposite to said inserting direction.

The above inventive terminal retainer comprises: a base plate; operating plates, respectively formed at opposite sides of said base plate, said operating plates being slidably movable over outer walls of said connector housing; retaining arms extending from a front end of said base plate; and spacer pieces, respectively disposed at front ends of said retaining arms, for locking said retaining lances.

Each of said retaining arms is provided with a fitting hole for receiving said retaining lance, said fitting hole extending respectively along lengths of said retaining arms and being respectively disposed centrally in width directions of said retaining arms. The retaining arms can be arranged in at least one of a plurality of rows and a plurality of stages, corresponding to said terminal receiving chambers. The inventive connector further comprises guide grooves, for guiding and holding said terminal retainer, formed respectively in rear end portions of opposite side walls of said connector housing. The inventive connector further comprises stoppers, formed on side walls of said connector housing, for positioning said terminal retainer in said first and second positions.

In the retaining method and construction of the present invention, after the connection terminal is inserted into the terminal receiving chamber to be retained by a retaining protuberance and an elastic retaining lance provided within the terminal receiving chamber, the terminal retainer is moved in a direction opposite to the inserting direction, thereby locking the retaining lance. When the terminal retainer in the provisionally-retained condition is moved in the direction opposite to the inserting direction, the elastic retaining lance, retaining the connection terminal within the terminal receiving chamber, is received in a flexing space for the retaining lance, which space is necessary when inserting and removing the connection terminal. As a result, the flexing of the retaining lance is prevented, and thus the connection terminal is retained within the terminal receiving chamber in a double manner easily and positively.

DETAILED DESCRIPTION OF THE PREFERRED EMBODIMENT

A retaining method, as well as a retaining construction, in one preferred embodiment of a double-retaining connector of the present invention, will now be described with reference to FIGS. 1 to 6. The present invention is not limited to the embodiment described below, and although this embodiment is directed to the male connector, the invention can be applied also to a female connector in a similar manner, and therefore a male connector housing will be hereinafter referred to merely as a "housing".

Figure 1:
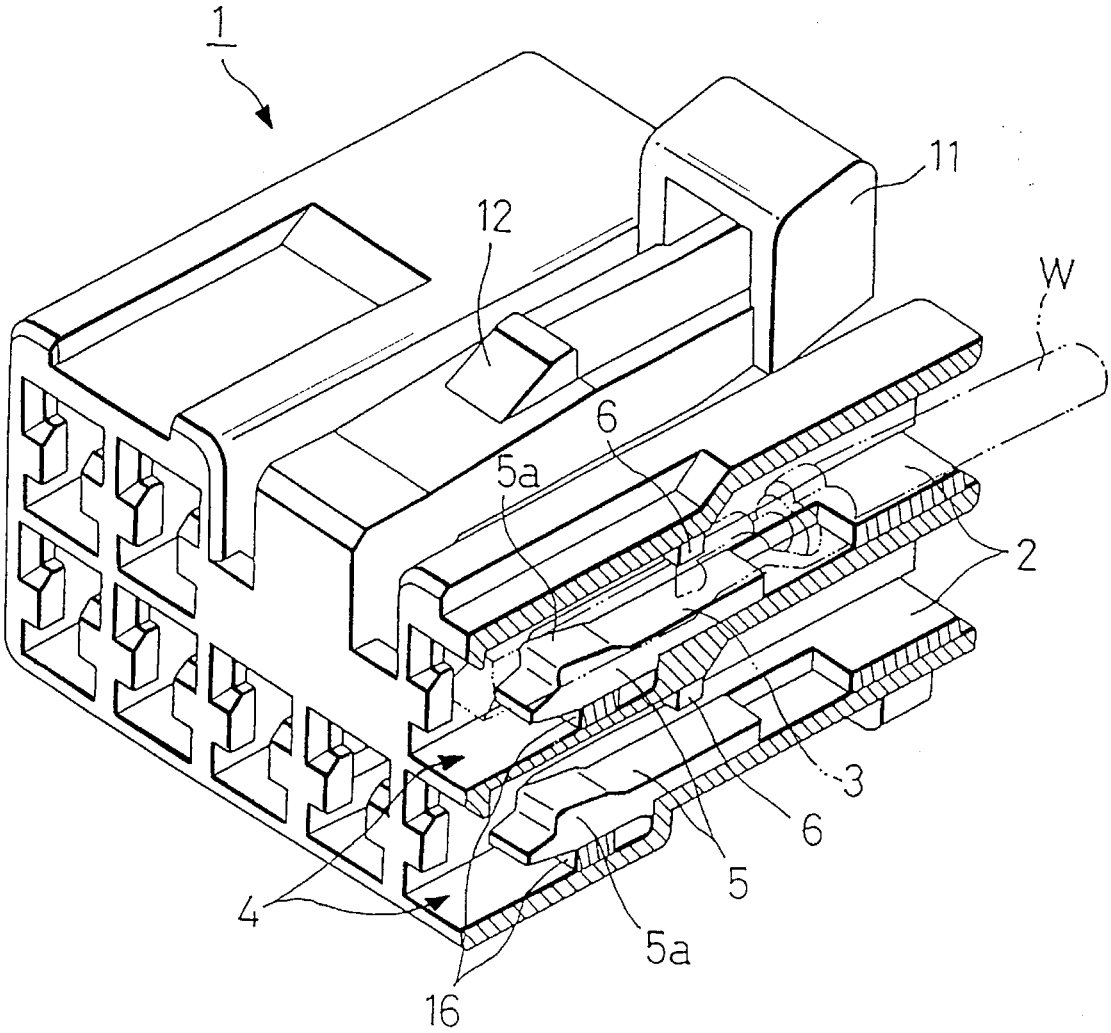
FIG. 1 is a perspective view showing a retaining method and a retaining construction in one preferred embodiment of a double-retaining connector of the invention.

As shown in FIG. 1, a fitting projection 12 for fitting in a mating housing, as well as a lock arm 11 for releasing the fitting, is formed on an outer wall of the male housing 1 made of a rigid synthetic resin. A plurality of terminal receiving chambers 4 for respectively receiving female connection terminals 3 each having a wire W connected thereto are formed within this housing, and are arranged in stages in a vertical direction.

An elastic retaining lance 5, serving as a retaining means for the connection terminal 3 and having a retaining projection 5*a*, is formed on an inner wall surface of the terminal receiving chamber 4. A retaining protuberance 6, for preventing a rearward withdrawal of the connection terminal 3, is formed on the inner wall surface facing the retaining lance 5.

A spacer 2 serving as the terminal retainer is initially inserted into the terminal receiving chambers 4 from the rear end of the housing 1 in the same direction as the direction of insertion of the connection terminals 3, before the connection terminals 3 are inserted into the respective terminal receiving chambers.

Figure 2:
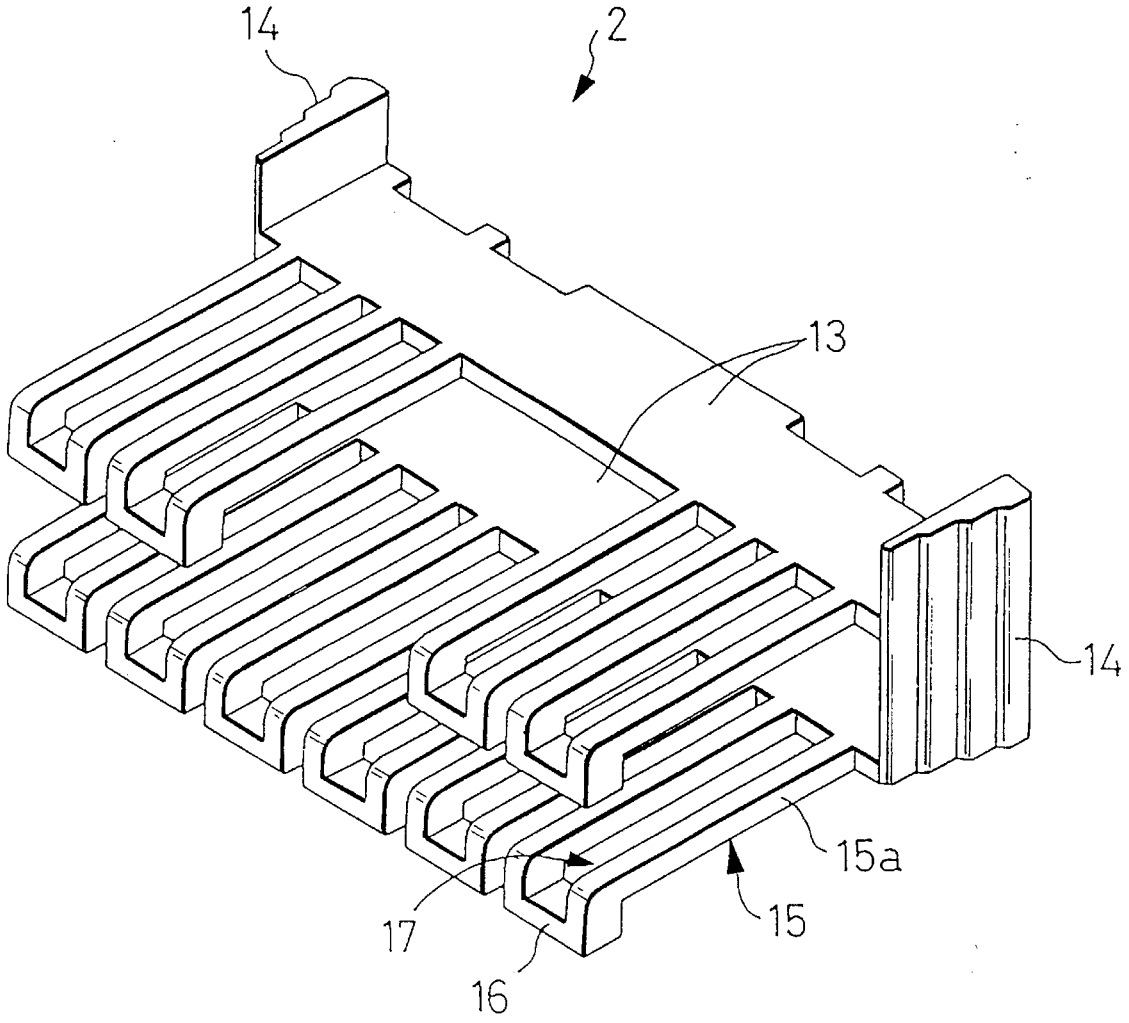
FIG. 2 is a perspective view of a spacer shown in FIG. 1.

As shown in FIG. 2, the spacer 2 is of a multi-stage construction, and includes base plates 13 interconnected at their rear ends, operating plates 14 of a stepped configuration formed respectively on opposite sides of the base plates 13, and retaining arms 15 extending forwardly from the base plates 13. Retaining arms 15 are arranged to correspond with the terminal receiving chambers 4. A user's fingers can directly contact the operating plates 14 to provide the requisite operating force.

Each retaining arm 15 includes an elastic arm portion 15*a*, a fitting hole 17 extending along the length thereof centrally of the width thereof for receiving the retaining lance 5, and a spacer piece 16 for locking the retaining lance 5. The spacer piece is formed at the front end of the arm portion 15*a* in stepped relation thereto.

Figure 3:
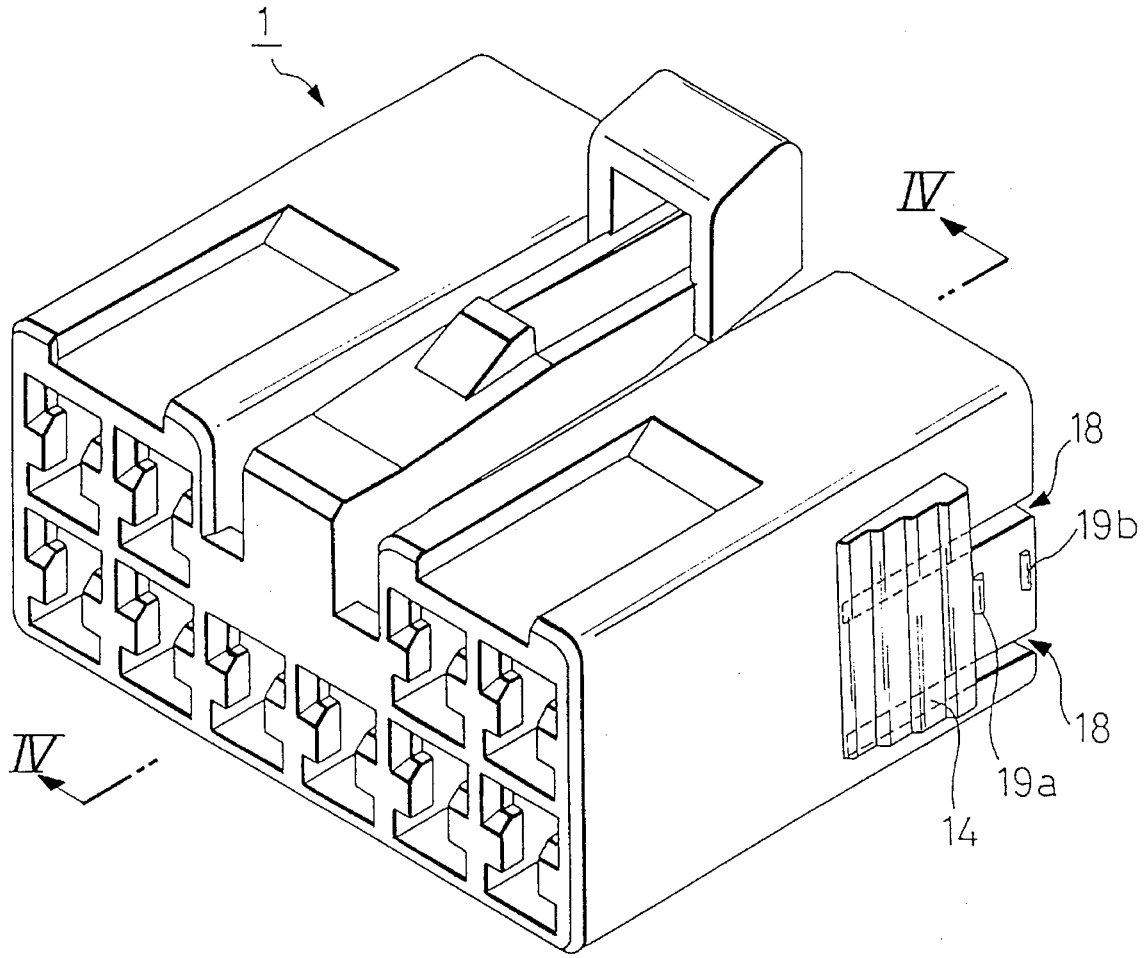
FIG. 3 is a perspective view showing a provisionally-retained condition of the spacer.

As shown in FIG. 3, slit-like guide grooves 18, for guiding the insertion of the spacer 2, are formed in the opposed side walls of the housing 1. In order to position the spacer 2 with respect to the terminal receiving chambers 4, a first stopper 19*a* for provisionally retaining the spacer 2 and a second stopper 19*b* for completely retaining the spacer 2 are formed on each of the opposed side walls of the housing 1. Each operating plate 14 slidably moves over the associated side wall of the housing, and is engageable with the associated first and second stoppers.

The procedure of mounting of the connection terminal 3 will now be described with reference to FIGS. 3 to 6.

Figure 4:
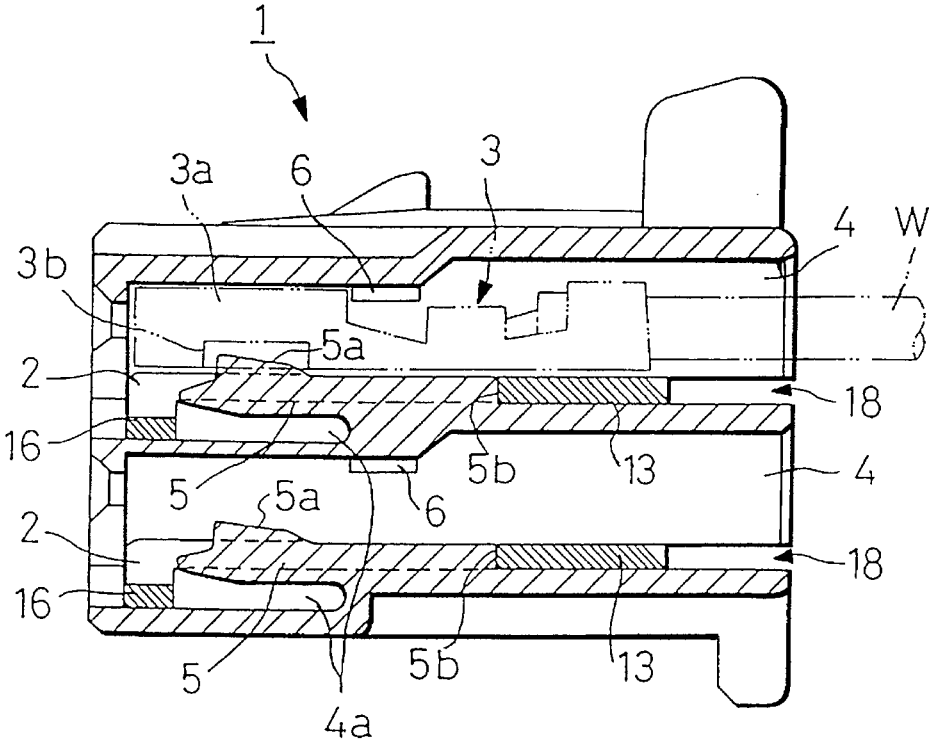
FIG. 4 is a cross-sectional view taken along the line IV—IV of FIG. 3.

First, the spacer 2 shown in FIG. 2 is inserted into the terminal receiving chambers 4 through a terminal insertion hole at the rear end of the housing 1 while being guided by the guide grooves 18, as shown in FIGS. 3 and 4. When the spacer 2 moves past the first stoppers 19*a*, the spacer is held in a provisionally-retained condition. At this time, each spacer piece 16 at the front end of the spacer 2 moves past the retaining projection 5*a* of the associated retaining lance 5, and is disposed in a stand-by condition forwardly of a flexing space 4*a* formed beneath the retaining lance 5 (see FIG. 4). More specifically, when the spacer piece 16 moves past the retaining projection 5*a* of the retaining lance 5, the entire the retaining lance 5 becomes fitted in the fitting hole 17, and the front end of the base plate 13 is abutted against a step portion 5*b* at the rear end of the retaining lance 5, so that the spacer is held in the provisionally-retained condition.

Then, as illustrated in FIG. 4, the connection terminal 3 is inserted into the terminal receiving chamber 4 through the terminal insertion hole at the rear end of the housing 1. An upper portion of an electrical contact portion 3*a* of the terminal moves past the retaining protuberance 6, and a rear end of the electrical contact portion 3*a* is abutted against the front end of the retaining protuberance 6, thereby preventing a rearward withdrawal of the connection terminal 3. At the same time, the retaining projection 5*a* of the retaining lance 5 is fitted in a retaining hole 3*b* in the electrical contact portion 3*a*, thereby achieving the double-retaining.

At this stage, however, the retaining lance can be flexed freely upon application of an external force, and the connection terminal 3 can be shaken within the terminal receiving chamber 4, and in some cases the terminal may be withdrawn therefrom rearwardly.

Figure 6:
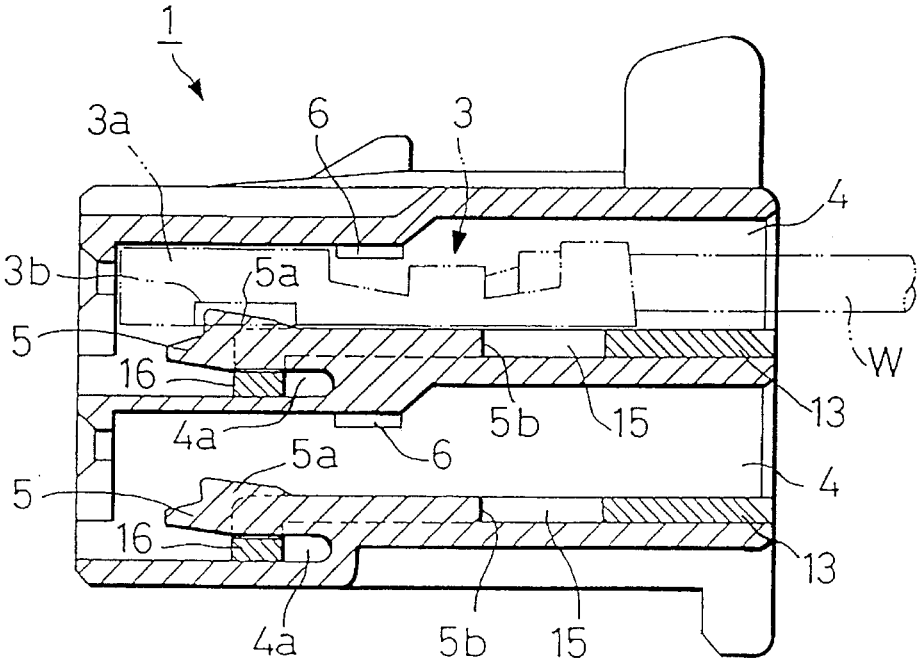
FIG. 6 is a cross-sectional view taken along the line VI—VI of FIG. 5.
Figure 5:
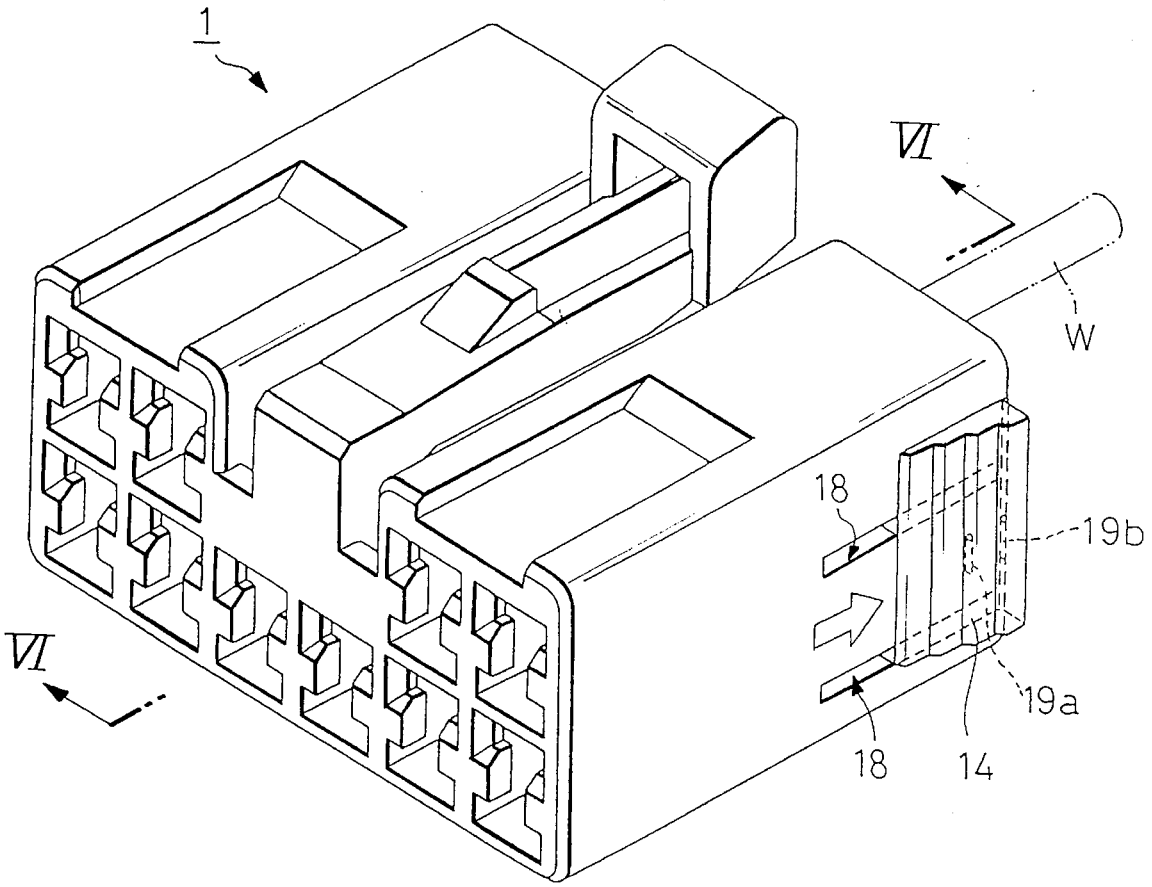
FIG. 5 is a perspective view of a connector housing, showing a completely-retained condition of the spacer.
Figure 7:
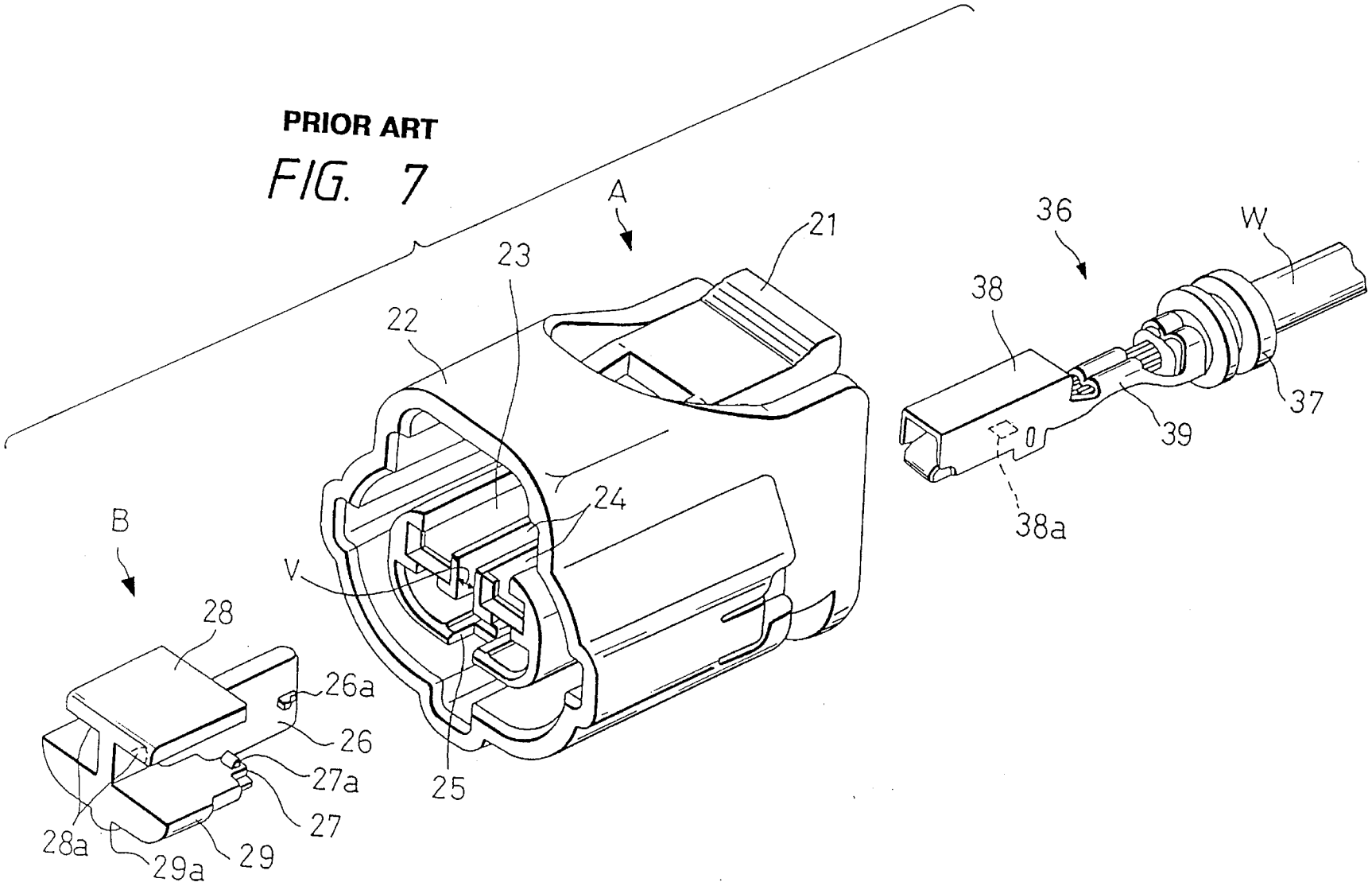
PRIOR ART FIG. 7
FIG. 7 is an exploded perspective view of a first conventional double-retaining connector.
Figure 8:
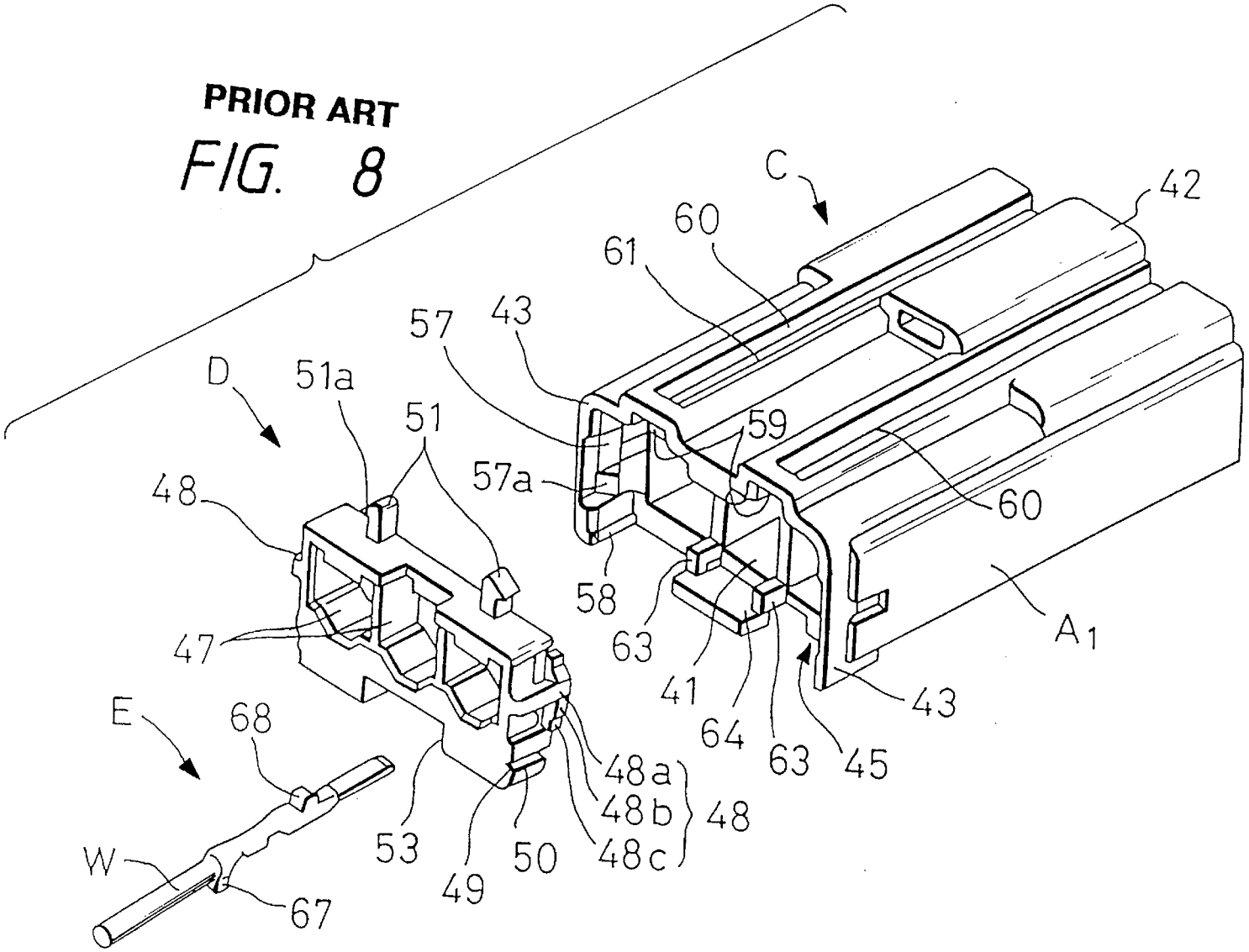
PRIOR ART FIG. 8
FIG. 8 is an exploded perspective view of a second conventional double-retaining connector.

Then, as shown in FIGS. 5 and 6, the two operating plates 14 of the spacer 2 are held by the hand, and then are pulled rearwardly (in a direction of the arrow in FIG. 5), that is, in a direction opposite to the direction of insertion of the connection terminal, so that the rear end of each of the operating plates 14 moves past the first stopper 19*a*, and is brought into abutment against the second stopper 19*b*. At this time, within the terminal receiving chamber 4, the base plate 13 moves rearwardly away from the step portion 5*b* of the retaining lance 5, and also the spacer piece 16 is received in the flexing space 4*a*. That is the, spacer piece 16 moves under the leading end of retaining lance 5. As a result, the flexing of the retaining lance 5 is prevented. Thus, within the terminal receiving chamber 4, the connection terminal 3 is retained in a double manner easily and positively.

The present invention is not limited to the above embodiment, and other forms of the invention can be provided by suitable modifications. For example, although the spacer piece 16 is supported at its opposite sides by two arm elements of the arm portion 15*a*, the spacer piece 16 does not always need to be supported at its opposite sides. Instead, it can be supported in a cantilever manner if strength requirements are met, and thus the arm portion 15*a* may comprise a single arm element.

As described above, in the retaining method and construction of the present invention, after the connection terminal is inserted into the terminal receiving chamber to be retained by the retaining protuberance and the elastic retaining lance provided within the terminal receiving chamber, the terminal retainer is moved in a direction opposite to the inserting direction, thereby locking the retaining lance. As a result, the retaining lance is prevented from being flexed, and the positive retaining of the connection terminal is ensured. Also, the retaining will not be released by an external force, thereby enhancing the reliability of the connector.

Moreover, the double retaining operation for the connection terminal can be effected easily and positively. The retaining constructions of the spacer and the connection terminal can be simplified, and therefore the cost of the product can be reduced.

What is claimed is:

1. A double-retaining connector for retaining connection terminals, comprising:

a connector housing;

terminal receiving chambers, for receiving the connection terminals, provided n said connector housing;

retaining protuberances, respectively provided in said terminal receiving chambers on respective first sides of said terminal receiving chambers, for retaining the connection terminals;

elastic retaining lances, respectively provided in said terminal receiving chambers on respective second sides of said terminal receiving chambers opposite said first sides, for retaining the connection terminals; and a spacer insertable into a rear end of said connector housing in an inserting direction, for retaining the connection terminals in said terminal receiving chambers and for receiving the retaining lances, wherein said spacer is selectively fixable in said connector housing in a first fully inserted provisional position in which said elastic retaining lances are not locked by said spacer and a second partially inserted final position in which said elastic retaining lances are locked by said spacer, said spacer being moved from said first position to said second position in a direction opposite to said inserting direction.

2. A double-retaining connector according to claim 1, wherein said spacer comprises:

a base plate;

operating plates, respectively formed at opposite sides of said base plate, said operating plates being slidably movable over outer walls of said connector housing;

retaining arms extending from a front end of said base plate; and spacer pieces, respectively disposed at front ends of said retaining arms, for locking said retaining lances.

3. A double-retaining connector according to claim 2, wherein each of said retaining arms is provided with a fitting hole for receiving said retaining lance, said fitting hole extending respectively along lengths of said retaining arms and being respectively disposed centrally in width directions of said retaining arms.

4. A double-retaining connector according to claim 2, wherein said retaining arms are arranged at in least one of a plurality of rows and a plurality of stages, corresponding to said terminal receiving chambers.

5. A double-retaining connector according to claim 1, further comprising guide grooves, for guiding and holding said spacer, formed respectively in rear end portions of opposite side walls of said connector housing.

6. A double-retaining connector according to claim 1, further comprising stoppers, formed on side walls of said connector housing, for positioning said spacer in said first and second positions.

* * * * *